US006494812B1

(12) United States Patent
Grimes, Jr.

(10) Patent No.: US 6,494,812 B1
(45) Date of Patent: Dec. 17, 2002

(54) INCLINED RAMP FOR TRACK AND FIELD TRAINING AND TRAINING METHODS THEREFOR

(76) Inventor: Charles R. Grimes, Jr., Malone College, 515 25th St., NW., Canton, OH (US) 44709

( * ) Notice: Subject to any disclaimer, the term of this patent is extended or adjusted under 35 U.S.C. 154(b) by 0 days.

(21) Appl. No.: 09/676,586

(22) Filed: Sep. 29, 2000

Related U.S. Application Data

(60) Provisional application No. 60/157,150, filed on Sep. 30, 1999.

(51) Int. Cl.[7] ..... A63K 3/00; A63B 5/00; A63B 26/00

(52) U.S. Cl. ..... 482/14; 482/15; 482/23

(58) Field of Search ..... 482/14–15, 30, 482/51, 52, 19, 23–25, 18; 119/843; 193/41; 105/436; 14/69.5; 128/845; 5/81.1 HS, 625

(56) References Cited

U.S. PATENT DOCUMENTS

| | | | | | |
|---|---|---|---|---|---|
| 249,475 | A | | 11/1881 | Medart | |
| 436,462 | A | | 9/1890 | Reach | |
| 1,104,505 | A | * | 7/1914 | Holworthy | 482/14 |
| D202,714 | S | | 11/1965 | Fenner et al. | |
| 3,356,367 | A | | 12/1967 | Tewksbury | |
| 3,401,931 | A | * | 9/1968 | McCafferty et al. | 272/59 |
| 3,433,477 | A | | 3/1969 | Roberts | |
| 3,746,335 | A | * | 7/1973 | Fichter et al. | 272/59 A |
| 3,837,643 | A | * | 9/1974 | Lee | 482/29 |
| 3,968,964 | A | | 7/1976 | Grosser et al. | |
| 4,045,021 | A | * | 8/1977 | Nissen | 482/29 |
| 5,209,709 | A | | 5/1993 | Eyman, Jr. | |
| 5,370,591 | A | | 12/1994 | Jewell et al. | |
| 5,562,575 | A | | 10/1996 | Gvoich | |
| 5,838,638 | A | | 11/1998 | Tipton et al. | |
| 5,879,272 | A | | 3/1999 | Mekjian | |
| 6,135,921 | A | * | 10/2000 | Holland et al. | 482/15 |

OTHER PUBLICATIONS

"Position Your Students for Good Starts", Strategies Journal, Sep. 1992 (1 page).

"Starting Technique of Elite American Female Sprinters," WomenScene, Feb. 1977 (1 page).

* cited by examiner

*Primary Examiner*—Michael A. Brown
*Assistant Examiner*—Lori Baker Amerson
(74) *Attorney, Agent, or Firm*—Flynn, Thiel, Boutell & Tanis, P.C.

(57) ABSTRACT

An inclined ramp is provided for practicing jumps and starts for track and field events. The inclined ramp includes a rigid inclined surface and is usable as part of two different training methods. The training method for jumps involves positioning the ramp near the landing zone with a lower end thereof nearest the approach area, while the training method for starts involves reversing the ramp so that the athlete's feet are on the higher upper end and the hands are on the low end.

22 Claims, 11 Drawing Sheets

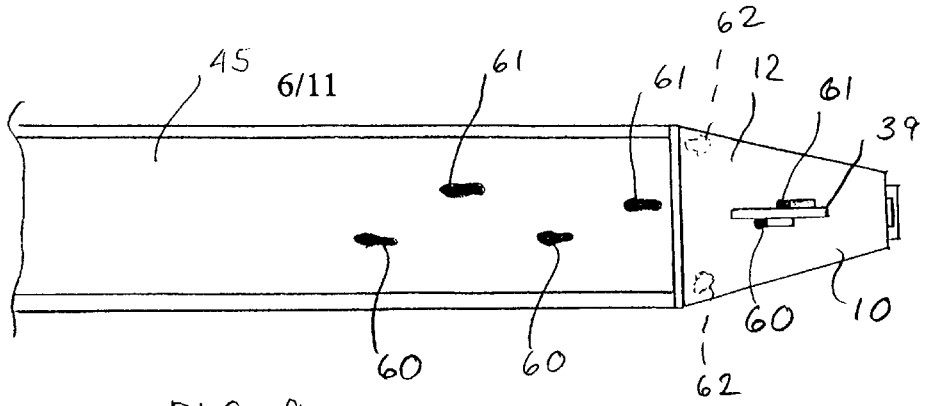
FIG. 9
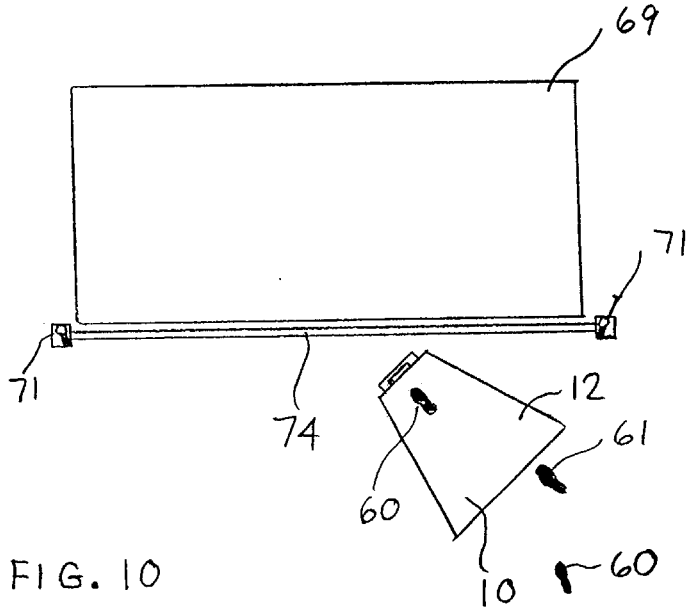
FIG. 10
FIG. 11
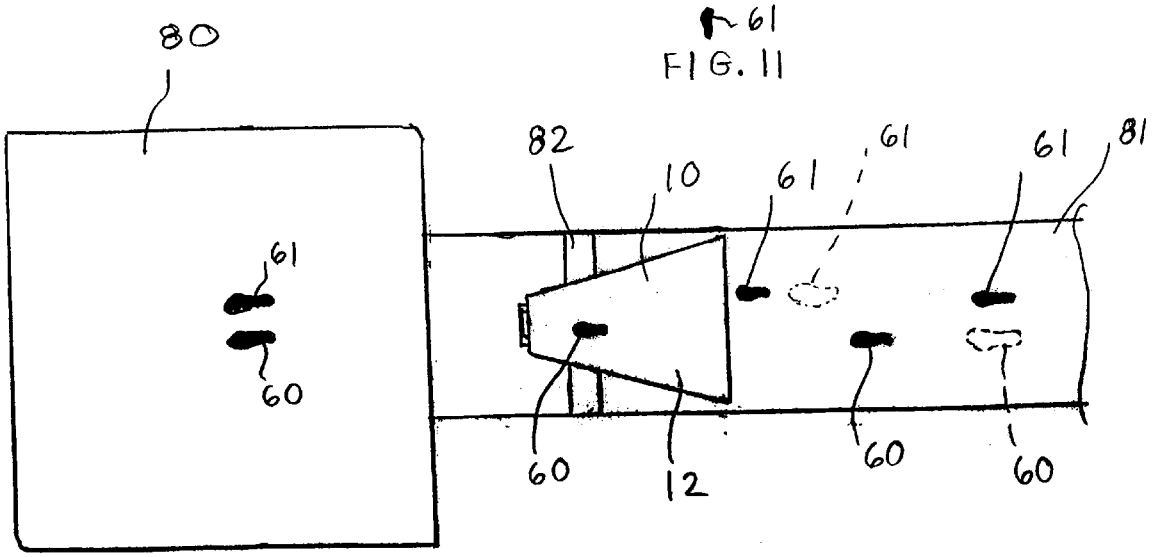

Five Meter sprint times

| | *Ramp* | *Flat* | |
|---|---|---|---|
| Men | 1.34 | 1.36 | -.02 (p<.05) |
| Women | 1.49 | 1.52 | -.03 (p<.05) |
| Both | 1.41 | 1.44 | -.03 (p<.05) |

Ten Meter Sprint times

| | *Ramp* | *Flat* | |
|---|---|---|---|
| Men | 1.99 | 2.02 | -.03 (p<.05) |
| Women | 2.23 | 2.26 | -.03 (p<.05) |
| Both | 2.10 | 2.13 | -.03 (p<.05) |

Flying Times*

| | *Ramp* | *Flat* | |
|---|---|---|---|
| Men | 653 | .656 | Not significant |
| Women | .744 | .746 | Not significant |
| Both | .695 | .698 | Not significant |

* "Flying time" represent the time elapsed between 5 and 10 meters

FIG. 14

Mean high jump clearances for each group were collected across eight weeks of the season. Ramps were used two days per week for technique training. Each group completed a 50-75 technique jump prescription during each week of observation. Participants (Men and Women) using the ramp for training improved 1.0 inches more than the group training normally.

Mean Long jump distances attained each week were recorded for each group. The ramp was used a total of two days per week for technique, as well as full run training. Each group conducted a 100-120 technique jumps prescription during each week of training. The ramp training improved performance 19.75 inches over normal training improvements.

Mean 100m sprint times for both men and women were collected each week of the season. The ramp was used a total of two days per week for start training. (a mean of 12 starts/week was observed in the Ramp group) Training with the ramp improved 100m sprint times .27 seconds over the normal training effect.

INCLINED RAMP FOR TRACK AND FIELD TRAINING AND TRAINING METHODS THEREFOR

CROSS REFERENCE TO RELATED APPLICATION

This application claims the benefit of U.S. Provisional Application No. 60/157 150, filed Sep. 30, 1999.

FIELD OF THE INVENTION

The invention relates to a training device and training methods for practicing and improving track and field events and in particular, for practicing starts and jumps for such events.

BACKGROUND OF THE INVENTION

In conventional track and field training, numerous practice repetitions are performed to improve performance. For those running events which start from a typical starters stance, it is important to practice starts since the ability to quickly transition upwardly from the starters stance to the running position can significantly improve performance. Similarly for jump events, it is important to maximize jumping abilities, particularly the pushoff from the takeoff or launch area, to improve the overall performance of the jumping event being performed. Examples of such jumping events include high jump, long jump and pole vault.

The invention relates to a training aid which improves the quality of practice repetitions for both running and jumping events and results in improved competition times when the running and jumping events are performed without the training aid. The training aid is a portable inclined ramp which is positioned within the start area for sprint training and the launch or takeoff area for jump training. The inclined ramp has an inclined surface covered with a track material and spikes which temporarily anchor the ramp in place on existing track material during training periods.

When used for sprint starts, the ramp faces toward the runway wherein starter blocks are placed on the ramp. When the athlete is in the start stance, the hands are lower than the feet which increases forward lean and improves the quality of training. For jumping events, the inclined ramp is placed next to the event apparatus such as the long jump pit or the high jump equipment, with the ramp facing toward the approach runway. The athlete runs to the inclined ramp and plants their push off foot on the inclined surface. The inclined ramp again improves the quality of training performed.

Therefore, a single training aid is provided which is usable for both start and jump training to improve competition performance.

Other objects and purposes of the invention, and variations thereof, will be apparent upon reading the following specification and inspecting the accompanying drawings.

BRIEF DESCRIPTION OF THE DRAWINGS

FIG. 9 is a diagrammatic plan view of the foot positions of a sprinter starting from the inclined training ramp.

FIG. 10 is a diagrammatic plan view of the foot positions of a high jumper using the inclined training ramp.

FIG. 11 is a diagrammatic plan view of the foot positions of a long jumper illustrated in solid and of a triple jumper illustrated in phantom outline.

FIG. 14 is a table comparing start times of sprinters using the training ramp and not using the training ramp.

Figure 1:
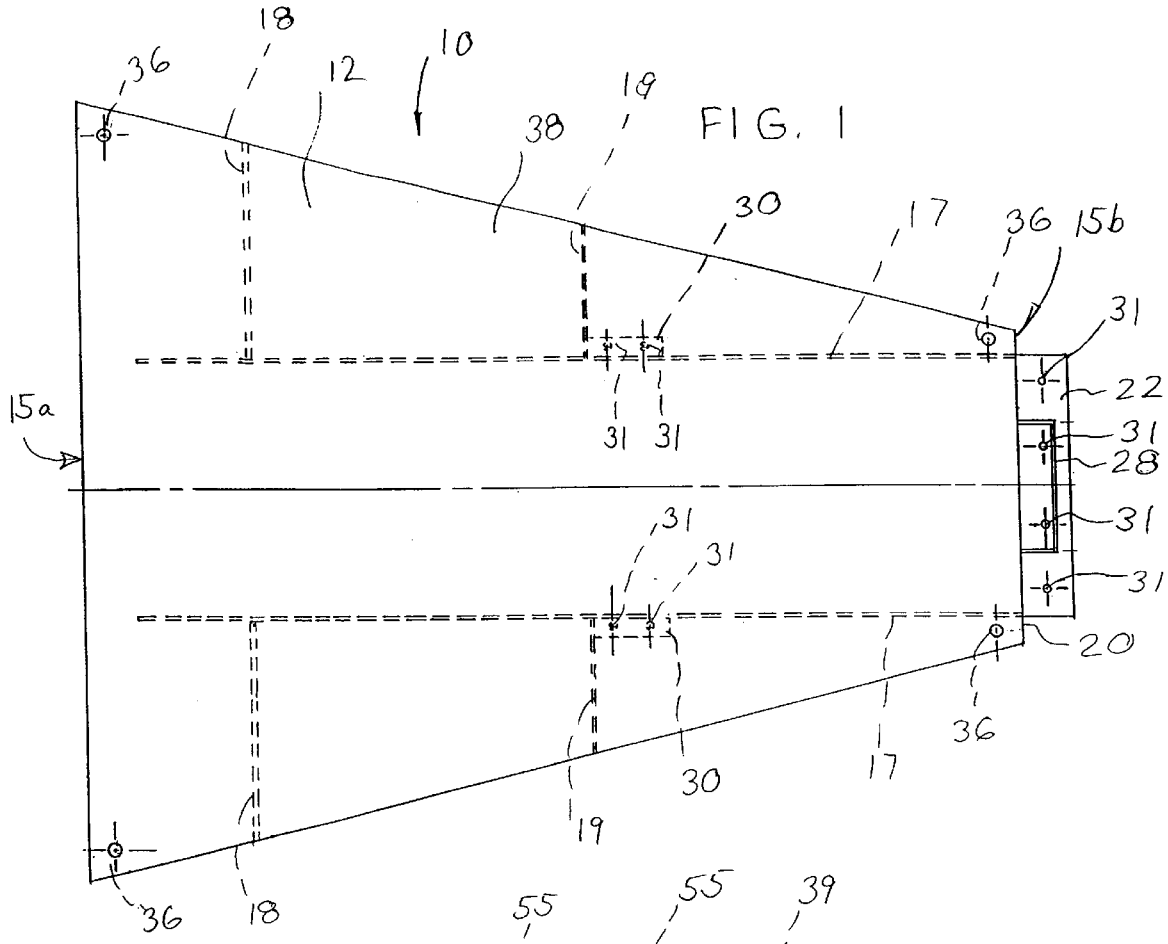
FIG. 1 is a plan view of an inclined training ramp of the invention for track and field training.

Certain terminology will be used in the following description for convenience in reference only, and will not be limiting. For example, the words "upwardly", "downwardly", "rightwardly"and "leftwardly"will refer to directions in the drawings to which reference is made. The words "inwardly"and "outwardly"will refer to directions toward and away from, respectively, the geometric center of the system and designated parts thereof. Said terminology will include the words specifically mentioned, derivatives thereof, and words of similar import.

DETAILED DESCRIPTION

Figure 2:
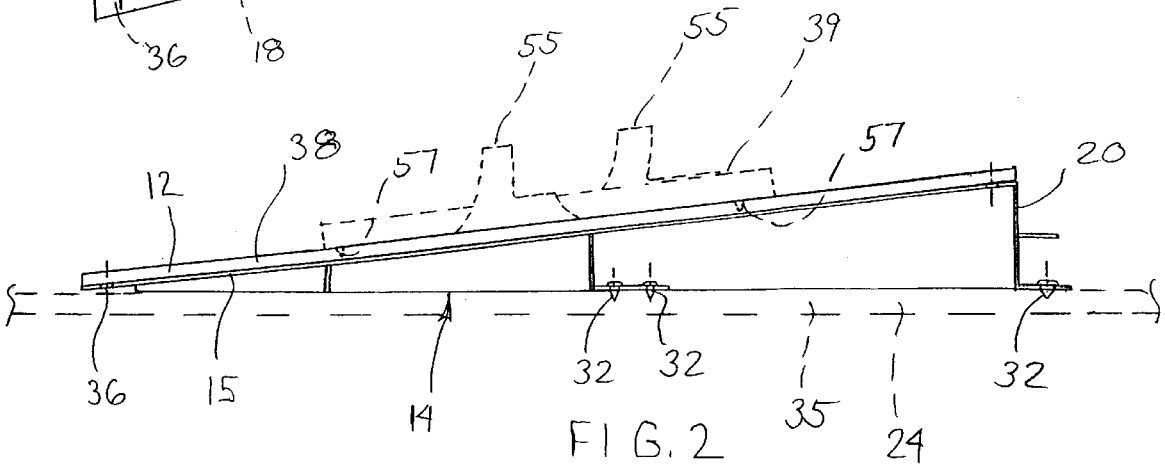
FIG. 2 is a left side elevational view of the training ramp which includes starter blocks illustrated in phantom outline.

The invention relates to an inclined training ramp 10 as illustrated in FIGS. 1 and 2, and the methods of using the training ramp 10 to practice jumps and starts for various track and field events which events are diagrammatically illustrated in FIGS. 9–12.

Figure 12:
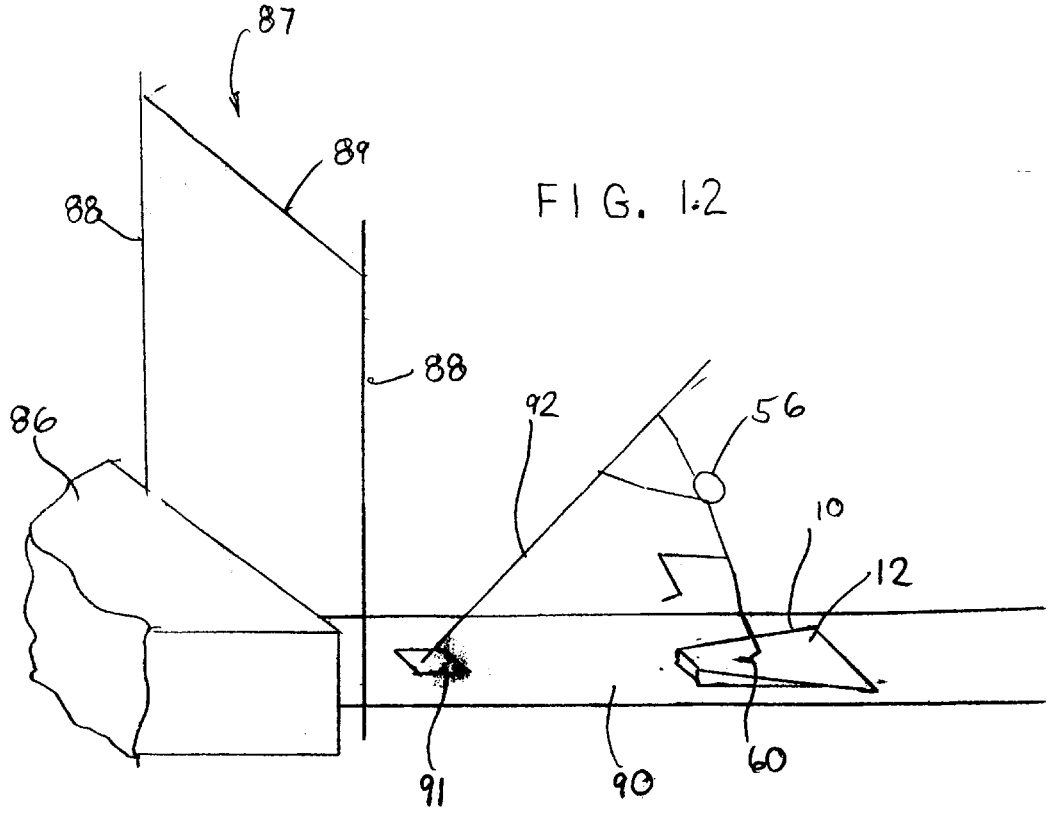
FIG. 12 is a diagrammatic front perspective view of a pole vaulter using the training ramp.

Generally, the inclined training ramp 10 may be positioned in a first orientation with an inclined surface 12 thereof facing forwardly for practicing starts as illustrated in FIGS. 1–4. Further, the training ramp 10 may be reversed and placed in a second orientation so that the inclined surface 12 faces rearwardly for use in practicing jumps such as for the high jump (FIGS. 7 and 10), the long jump or triple jump (FIG. 11), and the pole vault (FIG. 12). While the training ramp 10 typically is not used in competition, the inventive training ramp 10 and its methods of use have provided significant advantages in training which has resulted in improvements in competition results as discussed herein in further detail.

More specifically, the training ramp 10 includes a rigid frame structure 14 that includes a horizontally enlarged top plate 15 which is supported on upstanding webs 16.

Figure 3:
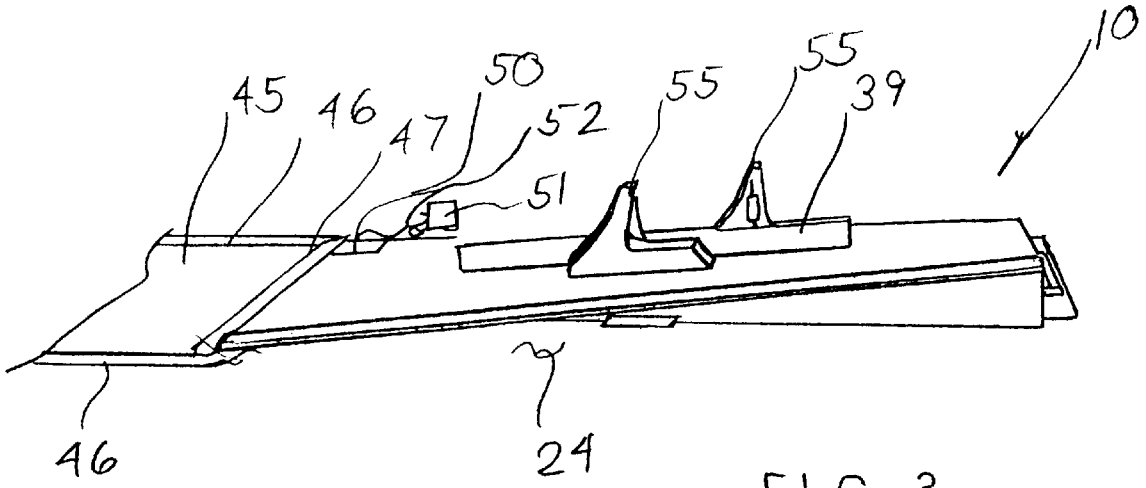
FIG. 3 is a left side perspective view of the training ramp and starter block of FIG. 2 positioned for use.

The top plate 15 is formed of a planar rigid material such as steel and has a wide front end 15*a* and a narrower rear end 15*b* so as to have a trapezoidal shape. The narrower end 15*b* generally defines the region in which a foot of a jumper is planted or the feet of a sprinter are placed. As such, the rear end 15*b* can be made narrower since the area required for placement of the feet is relatively narrow. However, when practicing starts, the corners of the training ramp 10 proximate front end 15*a* define areas in which the hands of a sprinter are placed and accordingly, the front end 15*a* is made wider to accommodate the spacing of the hands when an athlete is in the set position (FIG. 3).

The webs 16 include a pair of central webs 17 which extend generally rearwardly in parallel relation to each other and rigidly support the top plate 15 thereon. The webs 16 taper from the rear to the front of the training ramp 10 such that the top plate 15 is inclined upwardly. The top plate 15 preferably is inclined at an acute angle of 6.3 degrees although this angle may be varied. Further, the training ramp 10 preferably has an overall length of thirty-eight (38) inches which is sufficient to accommodate most athletes particularly for start training, and has a height of four (4) inches. The dimensional relationship between the length and height defines the aforementioned incline angle.

The frame structure 14 further includes front and rear pairs of transverse webs 18 and 19 respectively. The transverse webs 18 and 19 have inner ends which are rigidly connected to the central webs 17 and further extend outwardly to the outermost edges of the top plate 15. As such, significant support is provided to the top plate 15 even when the foot of a jumper is planted thereon so as to minimize if not eliminate deflection of the top plate 15 when jump forces are applied thereto.

Still further, the frame structure 14 includes a rear wall 20 which is rigidly connected to the rear ends of the central webs 17. The height of the rear wall 20 is selected so that the terminal rear edge of the top plate 15 is at the preferred height of four inches and the top plate 15 is inclined at the desired inclined angle.

To facilitate placement and repositioning of the training ramp 10 during use, a generally U-shaped handle 22 projects rearwardly from an exterior face of the rear wall 20. This allows a user to lift the rear of the training ramp 10 and carry same. During use, the training ramp 10 is laid flat on a suitable support surface 24 such as a track (FIGS. 2 and 3) or the like wherein the frame structure 14 is disposed in load bearing engagement with the support surface 24.

To prevent movement of the training ramp 10 during starts and jumps, the frame structure 14 further includes a rear anchor plate 28 which projects from the rear wall 20 and lies generally flat on the support surface 24 during use. The training ramp 10 also includes central anchor plates 30. Each of the anchor plates 28 and 30 includes holes 31 (FIG. 1) extending vertically therethrough wherein each of the holes 31 has an anchoring spike 32 (FIG. 2) which projects downwardly therefrom.

More particularly, the anchoring spikes 32 have threaded ends which engage the holes 31. For example, the spikes 32 may be conventional track spikes such as those used in running shoes. In use, the anchoring spikes 32 are embedded into the track surface 24 and prevent horizontal movement or shifting of the training ramp 10 during sprints and jumps. Since conventional track surfaces 24 typically are formed of a layer 35 of a rubberized or resilient track material, the spikes 32 readily engage the surfaces 24. The length of the spikes 32 may be varied depending upon the thickness and type of track material.

To prevent corrosion, the frame structure 14 is coated with a weather resistant material such as a nylon material or the like. This coating provides an aesthetically suitable finish while resisting corrosion. To facilitate coating of the frame structure 14, the top plate 15 also includes support holes 36, from which the frame structure 14 is suspended during the coating process.

The upper surface of the top plate 15 also includes a material layer 38, preferably of a rubberized track material. The material layer 38 not only permits use of shoes with spikes thereon, but the layer 38 also facilitates use of a conventional starter block 39 thereon. More specifically, the material layer 38 is bonded to the entire upper surface of the top plate 15 and has the same trapezoidal shape. Preferably, the material layer 38 is approximately a half-inch thick although other thicknesses may be suitable.

More specifically with respect to the methods of training with the training ramp 10, use of the training ramp 10 for starts is illustrated in further detail in FIGS. 2–6. Referring to FIGS. 2 and 3, the training ramp 10 is positioned with the front end 15*a* vertically adjacent to a lane 45 of a conventional track. A lane 45 typically includes longitudinal stripes or lines 46 which define the opposite side edges thereof. For training purposes, a starting line 47 preferably is provided which starting line 47 may be formed of a piece of white tape which is secured or adhered directly to the front edge of the ramp material 38.

To assist in timing starts, a hand pad 50 may be provided near one of the front corners of the ramp 10. The hand pad 15 is electronically connected to a timing device 51 through intermediate wiring 52. When an athlete's hand is removed during a start, the timing device 51 is automatically triggered. The hand pad 50 and timing device 51 are conventional and thus, a detailed discussion thereof is not necessary.

For start training, a conventional starter block 39 is placed on the top of the training ramp 10. The starter block 39 includes a pair of blocks 55 which project upwardly and typically are rearwardly offset relative to each other to accommodate the left and right feet of an athlete 56 who is training for starts. Conventional starter block 39 also includes spikes 57 (FIG. 2) which project downwardly and engage the ramp material 36 to prevent rearward shifting of the starter block 39 during use.

Figure 4:
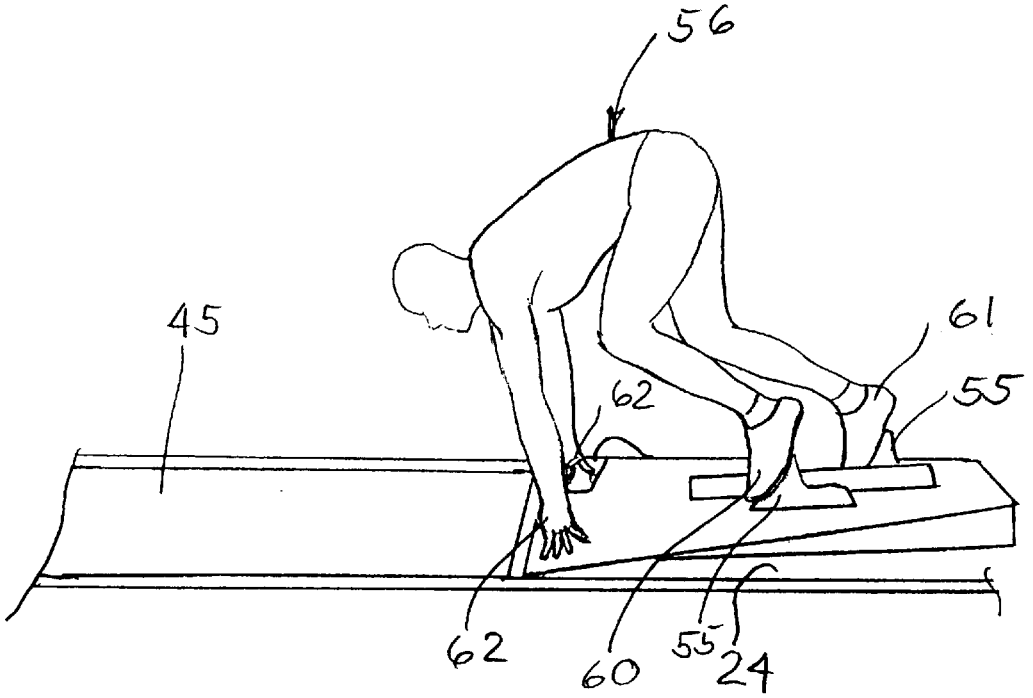
FIG. 4 is a left side perspective view illustrating an athlete positioned in the starter blocks.
Figure 5:
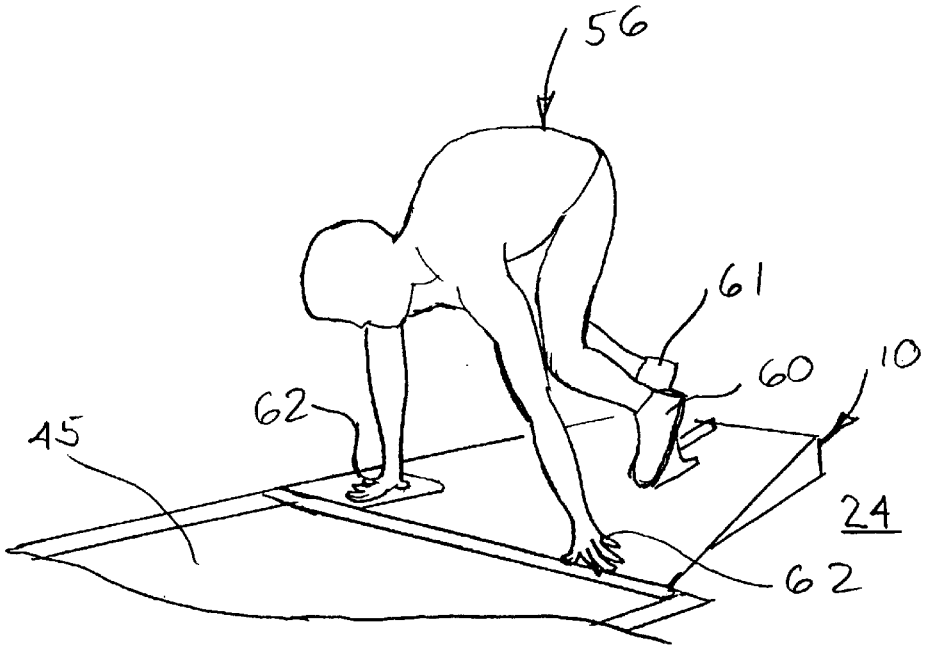
FIG. 5 is a front perspective view of the athlete of FIG. 4.

Referring to FIGS. 4 and 5, in a conventional start stance, the left and right feet 60 and 61 of the athlete 56 are positioned against their respective blocks 55, while the hands 62 of the athlete 56 are placed on the upper surface of the ramp 10 proximate the front corners thereof. To facilitate timing of the practice starts, the right hand 62 preferably is placed on the timer pad 50 which pad 50 registers the exact time which the hand 62 is removed during a start.

The athlete 56 thereby is supported entirely on the training ramp 10 during use. Since the ramp 10 is inclined, the athlete's feet 60 and 61 are disposed at a higher elevation than the hands 62 which forces the athlete 56 to lean forwardly when in the set position. As such, more of the athlete's bodyweight is shifted forwardly toward the hands 62. As discussed herein, this starting position has proven to be a more favorable position than would otherwise occur if the ramp 10 was not used.

Referring to FIG. 9, the subsequent movement and placement of the feet 60 and 61 during takeoff is illustrated therein. As can be seen, when the athlete 56 is in the start position, the feet 60 and 61 are placed in the blocks 55. While the left foot 60 is positioned forwardly of the rear foot 61, it will also be understood that some athletes 56 may perform better by reversing the position of the feet 60 and 61 with the forwardmost foot being the right foot 61.

During use, the training ramp 10 is positioned in a first orientation proximate a lane 45 wherein the ramp surface 12 faces forwardly in the direction in which the athlete 56 will be running. Preferably, the starter block 39 is then positioned thereon. The starter block 39 may be adjusted forwardly or rearwardly on the ramp material 36 to adjust the distance between the starting line and the blocks 55 and accommodate differences in the height of athletes 56 or allow use of different stances. Since the starter block 39 is maintained in position only by the spikes 57, shifting of the starter block 39 can be accomplished easily by raising and resetting the starter block 39.

Thereafter, the athlete 50 takes up the set position seen in FIGS. 4 and 5 wherein the feet 60 and 61 are positioned in the blocks 55 while the hands 62 are placed near the front corners of the training ramp 10. The athlete 56 then takes off or leaves the starter block 39 typically by driving with the forwardmost leg and foot 60. After an appropriate stride, the right foot 61 is planted on the lane 45 and the athlete 56 continues running as diagrammatically illustrated in FIG. 9.

Study results are provided herein which show that athlete's sprint times improved at a greater rate by training on the inventive training ramp 10. It is believed that this improvement results from several factors as discussed hereinafter.

More particularly, when training and practicing on a conventional flat surface for starts, particularly for sprints, several characteristics have been identified as contributing to efficient, effective sprint starts. In particular these factors include forward lean, knee drive, arm action and propulsive contact on the first step. Athletes and coaches therefore strive to optimize these characteristics although often times this can prove difficult, especially with novice athletes, since improved start times typically result from subjectively developing a "feel" for the optimal form which optimizes these characteristics.

The inventive training ramp 10 is believed to significantly improve the athlete's ability to optimize these characteristics. In particular, by using the starter block 39 in combination with the training ramp 10, the athlete when in the set position is tilted forwardly as illustrated in FIG. 4. As such, the athlete 56 is placed in a more favorable physical position and therefore is better able to develop a "feel" for the optimum form when starting.

Figure 6:
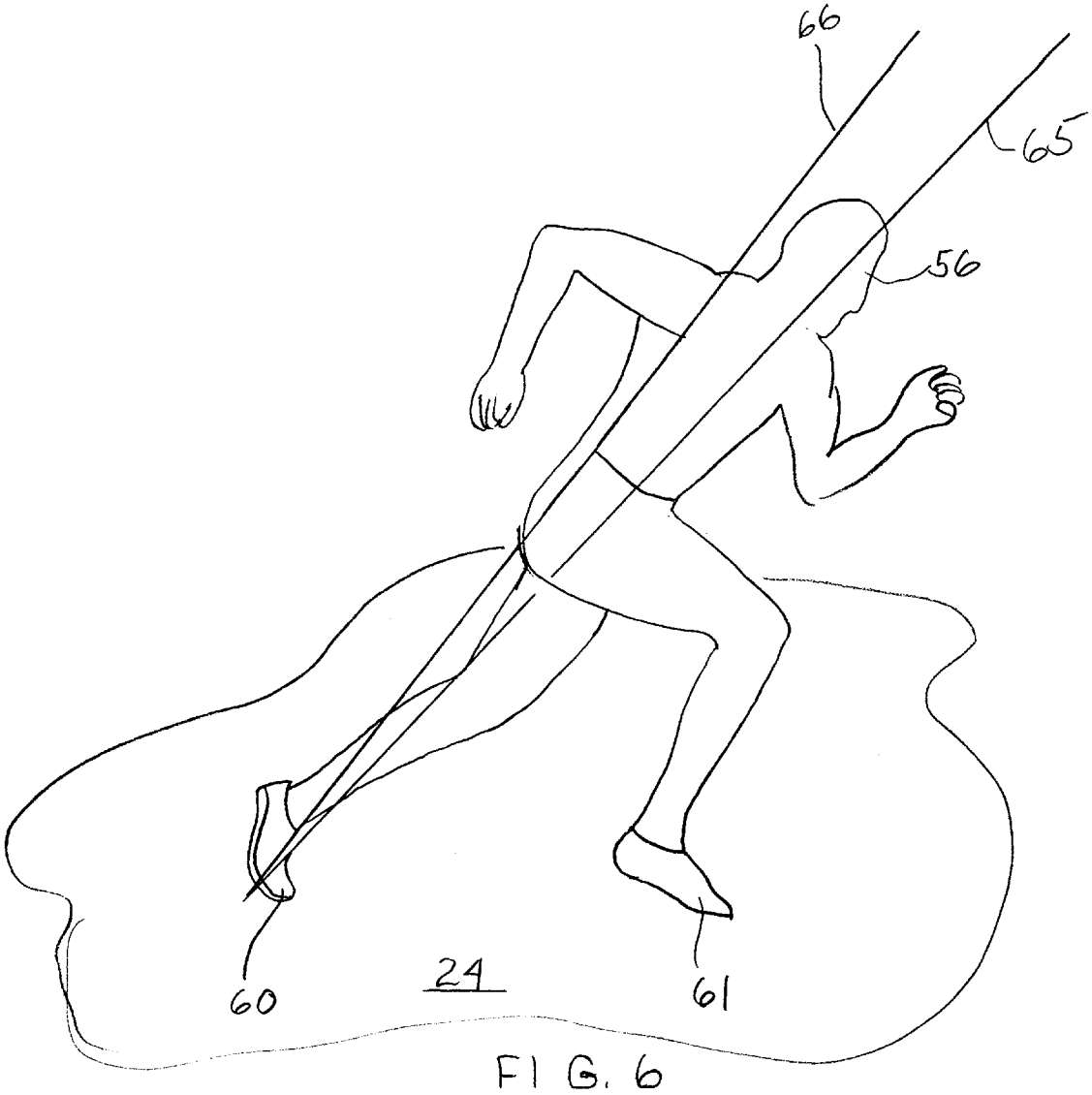
FIG. 6 is a right side elevational view of the athlete during a start from the training ramp.

As seen in FIG. 6, the athlete 26 when taking off from the starter block 36 has an improved angle of attack as designated by reference line 65 which reference line extends generally through the longitudinal center line of the athlete 56. This allows the athlete 56 to develop a more horizontal leg thrust as the athlete 56 rises from the starter block 39. This thereby increases the forward lean of the athlete 56 relative to a more vertical forward lean designated by reference line 66 which the athlete might typically use. This improved angle of attack or forward lean 65 not only allows the athlete 56 to develop a better "feel" for the optimum form during starts but also allows the athlete 56 to actually perform more starts during a training session with less effort or strength. The athlete 56 is better able to accomplish a greater number of correct or optimized starts, which thereby is believed to improve actual flat start times, i.e. starts conducted on conventional tracks without the training ramp 10. Further, starting from the ramp 10 also requires more aggressive arm action which further develops this beneficial characteristic.

In particular, the athlete develops a better "feel" for optimum form such that the practice times with the training ramp 10 are better. Further, this improvement in practice times also results in improvements in times during training and races conducted on flat surfaces without the training ramp 10. This improvement is believed to be shown by the test results discussed in further detail herein.

Besides providing distinct advantages when practicing starts, the training ramp 10 also provides distinct improvements when training for jumping vents such as the high jump, long jump, triple jump and pole vault.

When practicing for these jumping events, the training ramp 10 is usable therewith without any structural modifications. Rather, the training ramp 10 is merely positioned in a reversed second orientation wherein the inclined surface 12 faces towards the direction in which the athlete 56 will approach.

Figure 7:
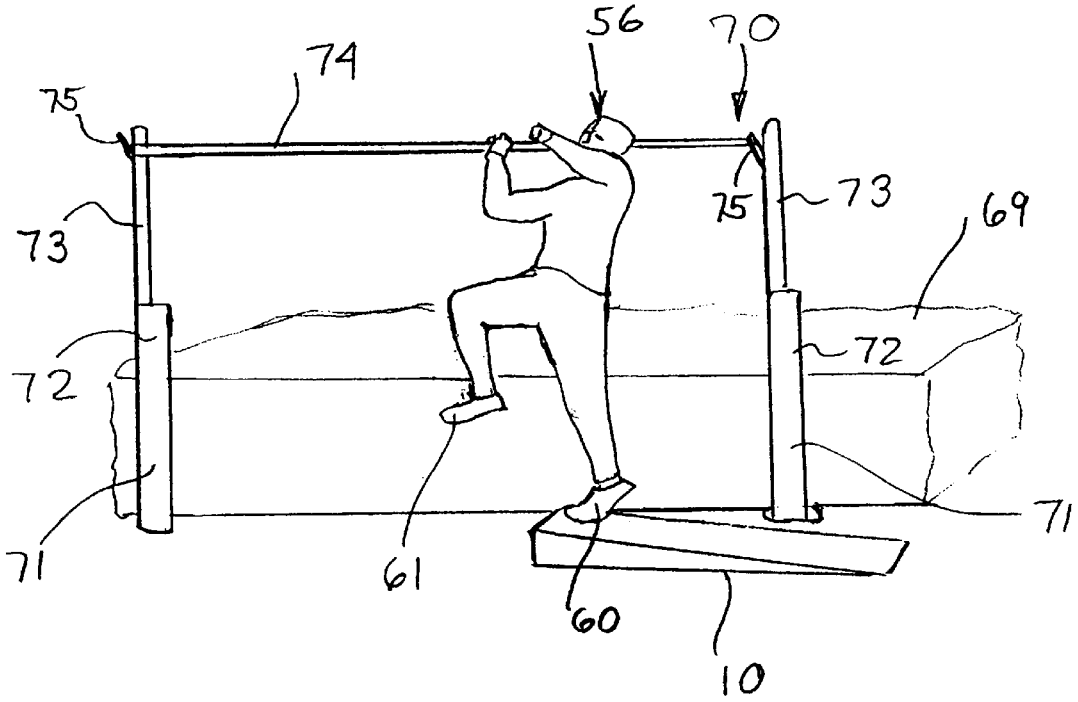
FIG. 7 is a front perspective view of a high jumper using the training ramp to practice high jumps.
Figure 8:
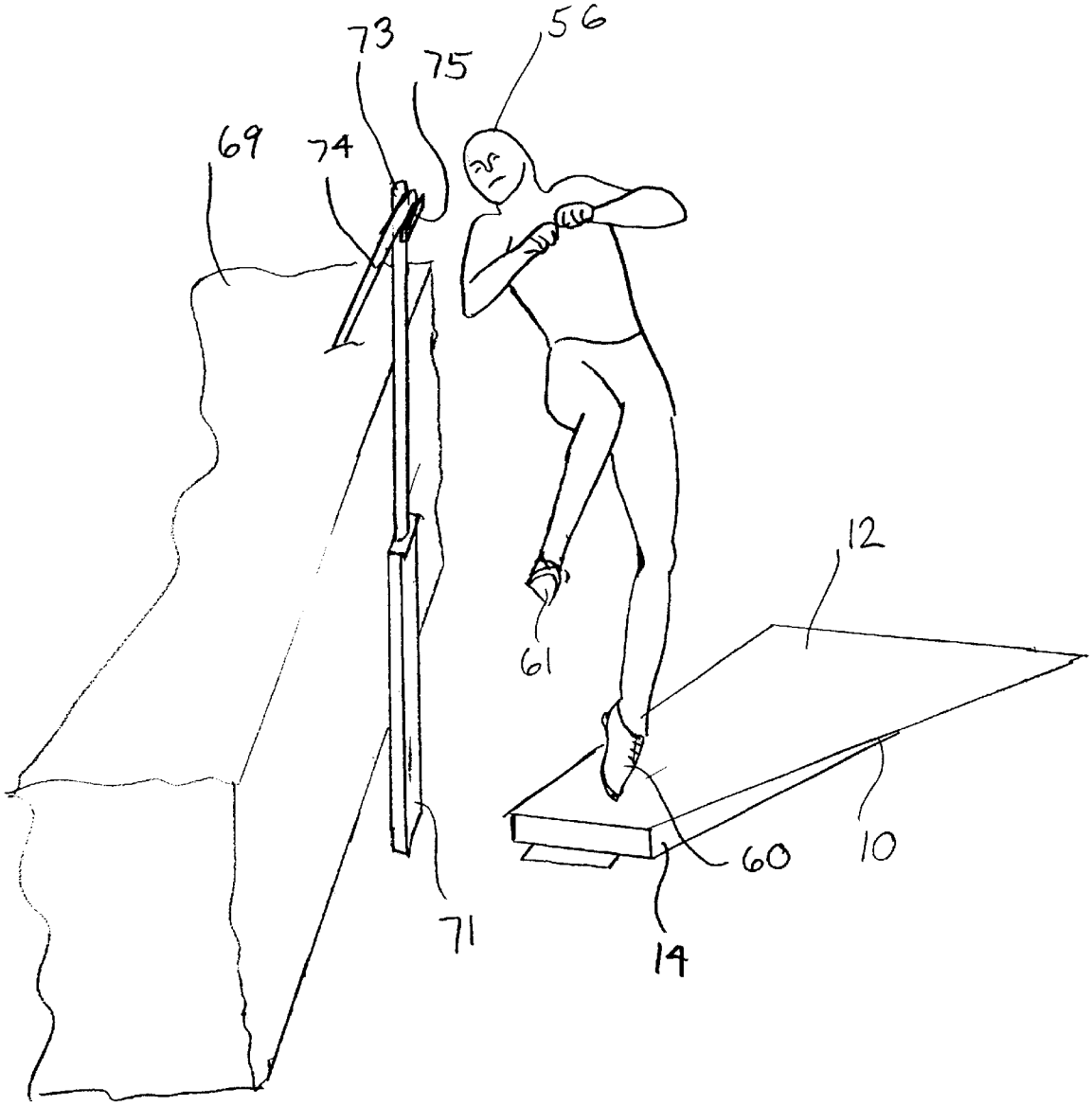
FIG. 8 is a side perspective view of the athlete practicing a high jump.

More specifically, FIGS. 7, 8 and 10 illustrate the training ramp 10 as used for practicing the high jump. The training ramp 10 is used with conventional high jump equipment which equipment includes a landing pad 69 and a crossbar arrangement 70. The crossbar arrangement 70 is conventional and includes a pair of support posts 71 which are laterally spaced apart and disposed proximate a front edge of the landing pad 69. The support posts included a lower base section 72, a vertically extendible upper section 73 and a crossbar 74. The opposite ends of the crossbar 74 are supported on support pegs 75 which project outwardly from the upper pole section 73.

While the object of high jumping obviously is to increase the elevational height of the crossbar 74 over which the jumpers are able to jump onto the landing pad 69, a critical part of such training and improvement is in developing proper form for the jump in combination with improvements in the physical abilities and strength of the athlete 56.

The training ramp 10 is used for practicing jumps by placing the training ramp 10 in the takeoff area in front of the crossbar arrangement 70. Specifically, the narrow end **15*b* of the training ramp 10 is disposed closely proximate to the crossbar arrangement 70 but the training ramp 10 is oriented generally at a forty-five (45) degree angle relative to the crossbar 74. Preferably, the upper third of the inclined surface 12 defines a target area in which the athlete 56 attempts to plant their takeoff or jumping foot which for the illustrated athlete 56 is the left foot 60**.

The athlete 56 uses a conventional form during practice; wherein the left foot 60 is planted while the right leg and foot 61 are lifted upwardly. The athlete 56 drives upwardly with the left leg and foot 60 during which time the athlete 56 arches their back when traveling over the crossbar 74. During the approach for takeoff, the athlete 56 also uses the conventional approach generally illustrated by the footprints of FIG. 11. While the general approach and jumping techniques are for the most part conventional, the training sessions are greatly improved by use of the inventive training ramp 10.

It is believed that the inclined angle of the take-off surface 12 modifies the interaction of the surface reaction force generated between the foot 60 and the inclined surface 12 when the foot is planted on the training ramp 12. This modified surface reaction force is believed to convert some of the jumper's ground speed into vertical lift to further improve the jumper's flight. Jumping height is also improved by the vertical height of the take-off area on which the foot 60 is planted.

Figure 13:
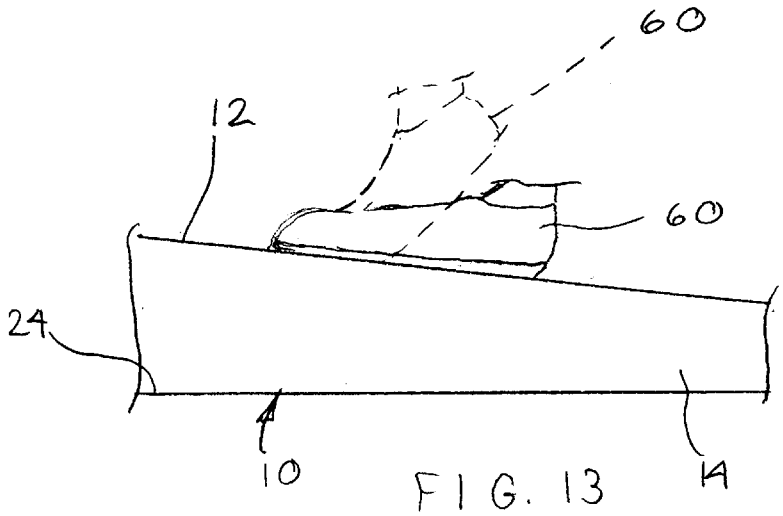
FIG. 13 is a partial side elevational view of the foot of a jumper in a planted position.

Still further, it is believed that the incline ramp 10 also improves the muscular development of the lifting muscles primarily in the ankle and foot area. Referring to FIG. 13, when the foot 60 is planted on the inclined surface 12, the heel 60*a* is actually at a lower elevation than the toe 60*b*. During a jump, the heel 60*a* travels from the lower position illustrated in solid upwardly to the upper position illustrated in phantom outline which positions thereby define the vertical range of motion through which the heel 60*a* travels. This vertical range of motion is greater than the vertical range of motion of the heel when jumping from a flat surface since the heel starts at a lower elevation relative to the toe 60*b* on the ramp 10.

Since the foot 60 generates a lifting force, the foot 60 actually works through the greater vertical range of motion which is believed to improve muscular development and thereby improve jumping ability. This increased angular range of motion not only occurs in the ankle joint through the increased vertical range of motion of the heel 60*a*, but also in the joint at the ball of the foot. In particular, since the toes 60*b* also are at an inclined angle, pivoting of the foot 60 about this joint occurs through a greater angular range. This unique motion thereby results in increased contact time of the foot 60 with the ramp 10 which emphasizes the jumping movement and is believed to improve the muscular impulse generated by the foot joints.

Further, since the inclined surface 12 is rigid, the angle of the surface reaction force remains constant along the length of the training ramp 10, thus, allowing the same ankle flexion to occur during each jump regardless of the position of the foot 60. Thus, even if the planting location of the foot 60 varies upwardly, downwardly or sidewardly on the ramp 10 during repeated practice runs, the improved motion of the ankle is maintained substantially constant.

This cooperation between the inclined surface 12 and the jumping foot 60 is believed more conducive to jump training. More particularly, the incline in combination with the height of the training ramp 10 makes it easier to accomplish the same jump with the ramp 10 than without the ramp 10 and accordingly, training is less exhausting. This permits shorter runs up to take-off location on the ramp 10, and more attempts per session. The training ramp 10 also is believed to adjust the jumper's flight during practice and aid in muscular development. Since the quality and quantity of training is increased, greater improvements may be achieved.

As mentioned previously, the training ramp 10 may be used for a variety of jumping events. For example, referring to FIG. 11, the training ramp 10 is positioned for use when training for the long jump. Equipment for the long jump is conventional and typically includes a landing pit 80 which is filled with loose sand, a runway 81 which extends forwardly to the landing pit 80 and a fault line or toe board 82 which extends transversely across the runway 81. Typically, the runway 81 includes a suitable track material such as that used for the sprint lane 45.

During training, the training ramp 10 is positioned on the runway 81 proximate to the landing pit 80. While the training ramp 10 is at least positioned proximate to the toe board 82, the training ramp preferably is positioned so that it overlies the toe board. While this position still requires the athlete to plant their foot 60 and jump before reaching the toe board 82 to avoid a fault, at least an end portion of the training ramp 10 extends beyond the toe board 82 so that the preferred foot planting position is disposed approximately two-thirds of the way up the inclined surface 12. This permits the athlete, if a fault occurs, to still land on the ramp 10 without stepping off of the ramp 10. Once the athlete lands in the landing pit 80, the feet 60 and 61 are generally disposed in a side-by-side position.

The same equipment and arrangement of the training ramp 10 may also be used for training for the triple jump. In the triple jump, the steps on the runway 81 are farther apart as generally illustrated in phantom outline for feet 60 and 61. The final step for the third phase of the triple jump still occurs on the training ramp 10 as illustrated in solid by footprint 60.

When jumping from the training ramp 10 during the long jump and triple jump, the interaction of the training ramp 10 and foot 60 is substantially the same as that discussed above with respect to the high jump and as illustrated in FIG. 13. Thus, the foregoing discussion of the benefits of the training ramp 10 during jumping events is believed equally applicable to the high jump and triple jump.

Further, the training ramp 10 also is believed to provide similar advantages to training for the pole vault as diagrammatically illustrated in FIG. 12. The pole vault equipment includes a landing pad 86, a crossbar arrangement 87 having vertical support posts 88 and a crossbar 89, and a runway 90 leading up to the crossbar arrangement 87. The runway 90 includes a plant box 91 which receives the lower end of a vaulting pole 92 during a pole vault.

As generally illustrated in FIG. 12, the training ramp 10 is spaced away from the plant box 91 a distance which is proximate the distance between the planting foot 60 of the athlete 56 and the lower end of the pole 92. As such, as the athlete 56 drives the pole 92 into the plant box 91, the jump leg 60 of the athlete 56 is planted onto the inclined surface 12 of the ramp 10 which allows the athlete 56 to drive upwardly therefrom. It is believed that use of the training ramp 10 with pole vaulting also provide advantages and improvements in performance.

As discussed hereinafter, a significant amount of experimentation has been conducted on use of the training ramp 10 for sprint starts and jump starts, and significant benefits are believed to be shown by the results of this experimentation which results are set forth in FIGS. 14–17.

Referring to FIG. 14, a first experiment was conducted by comparing sprint start times of a group of athletes for starts first conducted on a flat surface without the training ramp 10 and then for starts conducted with the ramp 10. Specifically, a group of 13 college aged sprinters performed a number of five-meter and ten-meter sprint starts with the training ramp 10 (designated "Ramp" in FIG. 14) and without the training ramp 10 (designated "Flat"). The test starts included four on the normal flat surface, and four with starting blocks placed on top of the training ramp 10. All of the trial times were measured by fully automatic timing in seconds, and the mean differences between the trials for all participants are set forth in FIG. 14.

As can be seen, significant improvements were measured when using the ramp even with no prior experience with the ramp 10. The study indicates that the training ramp 10 of the invention creates a more favorable body positioned for accelerating. These improvements are attributed to be improved body lean during set and take-off phases of the sprint start, increases in stride length during the first three steps from the blocks while maintaining a favorable body angle, and a demand for greater arm action which creates a more aggressive starting action which increased arm action is reported by a post use participant survey.

Figure 15:
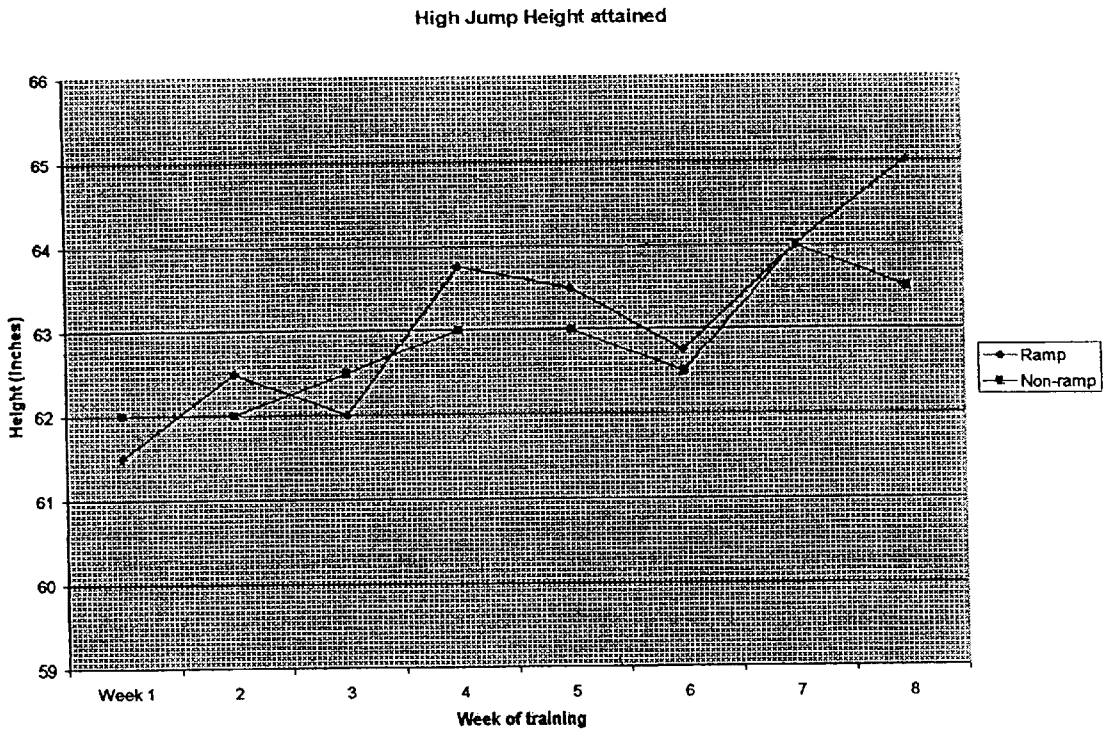
FIG. 15 is a graph comparing the high jump results of a test group using the training ramp and a non-ramp control group.
Figure 16:
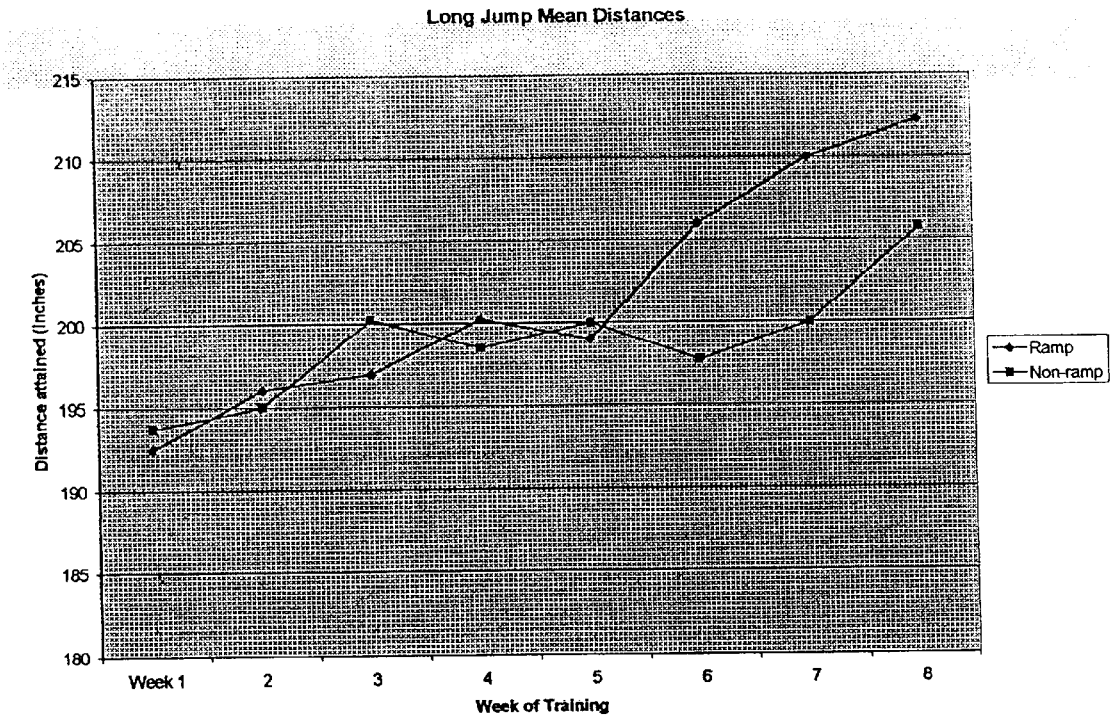
FIG. 16 is a graph comparing the long jump results of a test group using the training ramp and a non-ramp control group.
Figure 17:
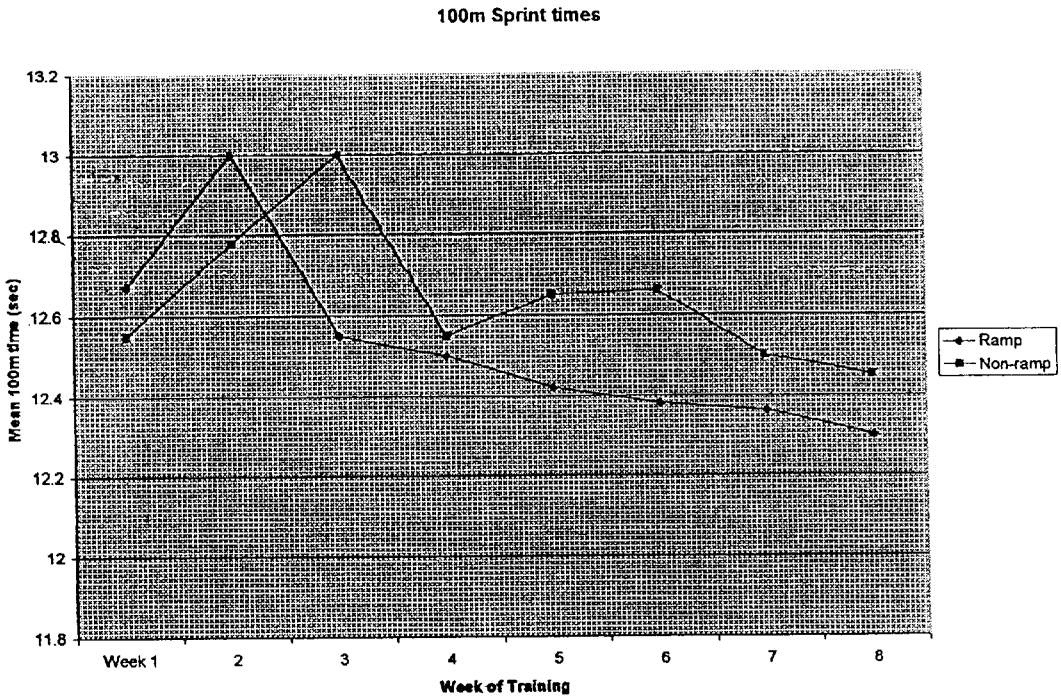
FIG. 17 is a graph comparing the 100 meter sprint times of a test group using the training ramp and a non-ramp control group.

Referring to FIGS. 15–17, another experiment was conducted to further investigate the effects of training with the training ramp 10. FIGS. 15–17 are graphs which depict the results of training with the ramp 10 over a period of eight weeks.

More specifically, seventy-eight (78) high school aged athletes trained for eight weeks with and without the training ramp 10. Thirty-six of these athletes utilized the ramp wherein 20 used the ramp for jumping events and 16 used the ramp for sprint starts. The remaining 36 athletes trained normally without utilizing the ramp 10 wherein 20 athletes trained for jumping events and 16 athletes trained for sprint events. Data was collected for training volume, competition performances and improvements therein, personal best efforts, and incidents of injury which factors were monitored for eight continuous weeks.

Generally, the graphs of FIGS. 15–17 reveal significant improvements in the test group using the ramp 10 for the long jump, high jump and 100 meter sprint. As seen in FIG. 15, the high jump test group had an overall improvement at the end of the test which was more than 1.0 inch greater than the non-ramp control group. Referring to FIG. 16, the long jump test group improved more than six inches over the non-ramp control group. Referring to FIG. 17, the sprint test group improved more than 0.27 seconds over the non-ramp control group. This test data is believed to show the significant improvements which may be attained by using the training ramp 10 of the invention in the training methods disclosed herein.

Although a particular embodiment of the invention has been disclosed in detail for illustrative purposes, it will be recognized that variations or modifications of the disclosed apparatus, including the rearrangement of parts, and of the methods of use lie within the scope of the present invention.

What is claimed is:

1. A training method for improving the jumping performance of an athlete when training for an athletic jumping event which is performed in an event area, said event area including a landing area which extends in a longitudinal direction, a takeoff area which is adjacent an end of said landing area, and an approach area which extends in said longitudinal direction toward said takeoff area, said method comprising the steps of:

providing an inclined ramp which has a bottom support surface and an inclined surface, said inclined surface having a lower end disposed near said approach area and an upper end disposed near said landing area;

positioning said inclined ramp within said takeoff area wherein said bottom support surface is laid on an upward facing takeoff surface of said takeoff area and said inclined surface is inclined upwardly away from said approach area, said inclined surface being rigid between said upper and lower ends and defining a target area near said upper end for planting a foot of a push off leg of the athlete;

said athlete performing the steps of:

running through said approach area toward said takeoff area;

planting said foot of said push off leg on the inclined surface within said target area;

pushing off of said inclined ramp with said push off leg to perform a jump technique corresponding to said jump event for which said training is being performed, said athlete jumping in said longitudinal direction directly from said target area to a landing location within said landing area wherein said athlete comes to a stop in said landing location.

2. The training method according to claim 1, wherein said takeoff surface is substantially horizontal and said inclined surface is oriented at an acute angle relative to said takeoff surface so that said foot of said push off leg is planted near an upper end of said inclined surface at a corresponding acute angle.

3. The training method according to claim 2, wherein said pushing off of said inclined ramp includes articulating said push off foot upwardly about a ball of said pushoff foot from a lowered positioned to a raised position to propel said athlete directly to said landing area.

4. The training method according to claim 1, wherein said athlete jumps longitudinally from said takeoff area to said landing area in a jumping direction, said inclined surface extending longitudinally, generally in the same direction as said jumping direction.

5. A training method for improving the jumping performance of an athlete when training for an athletic jumping event which is performed in an event area, said event area including a landing area, a takeoff area which is adjacent said landing area, and an approach area which extends toward said takeoff area, said method comprising the steps of:

providing an inclined ramp which has a bottom support surface and an inclined surface;

positioning said inclined ramp within said takeoff area wherein said bottom support surface is laid on an upward facing takeoff surface of said takeoff area and said inclined surface is inclined upwardly away from said approach area, said inclined surface defining a target area for planting a foot of a push off leg of the athlete;

said athlete performing the steps of:

running through said approach area toward said takeoff area;

planting said foot of said push off leg on the inclined surface within said target zone; and pushing off of said inclined ramp with said push off leg to perform a jump technique corresponding to said jump event for which said training is being performed, said athlete jumping longitudinally from said takeoff area to said landing area in the jumping direction, said inclined surface being oriented generally transverse to said jumping direction.

6. A training method for improving the jumping performance of an athlete when training for an athletic jumping event which is performed in an event area, said event area including a landing area, a takeoff area which is adjacent said landing area, and an approach area which extends toward said takeoff area, said method comprising the steps of:

providing an inclined ramp which has a bottom support surface and an inclined surface;

positioning said inclined ramp within said takeoff area wherein said bottom support surface is laid on an upward facing takeoff surface of said takeoff area and said inclined surface is inclined upwardly away from said approach area, said inclined surface defining a target area for planting a foot of a push off leg of the athlete, said positioning of said inclined ramp including providing stakes which project downwardly from said bottom surface of said inclined ramp to prevent movement of said ramp within said take off area;

said athlete performing the steps of:

running through said approach area toward said takeoff area;

planting said foot of said push off leg on the inclined surface within said target zone; and pushing off of said inclined ramp with said push off leg to perform a jump technique corresponding to said jump event for which said training is being performed.

7. The training method according to claim 1, wherein said inclined surface is rigid.

8. A training method for improving starting performance of a runner when training for an athletic running event which is performed in an event area, said event area including a start area and a runway area which extends away from said start area, said method comprising the steps of:

providing an inclined ramp which has a bottom support surface and an inclined surface;

positioning said inclined ramp within said start area wherein said bottom support surface is laid on an upward facing start surface of said start area and said inclined surface inclines upwardly away from said runway area so as to generally face toward said runway, said inclined surface having an upper end section and lower end section for supporting said athlete thereon in a sprinter start stance;

said athlete performing the steps of:

placing both of the athlete's feet on said upper end of said inclined surface;

placing both of the athlete's hands on said lower end of said inclined surface wherein said hands are at a lower elevation than said feet;

positioning the athlete's body in a starter stance wherein said lower elevation of said hands promotes a forward lean of said athlete; and driving the athlete's legs downwardly to move said athlete to a running position and then running through said runway area.

9. The training method according to claim 8, including the step of positioning a starter block on said inclined ramp for supporting said athlete's feet when in said starter stance.

10. The training method according to claim 9, including the steps of providing said inclined ramp with a cushion on an upper surface thereof, said starter block having projections which engage said cushion to prevent shifting of said starter block.

11. The training method according to claim 10, wherein said cushion is an elastomeric layer.

12. The training method according to claim 8, wherein said lower end of said inclined ramp has a wider width than said upper end to accommodate a spacing of said hands which is greater than a spacing of said feet.

13. The training method according to claim 8, wherein said inclined ramp includes a rigid frame having downwardly projecting anchors that removably engage a surface of said start area.

14. The training method according to claim 13, wherein said inclined ramp is movable from said start area away from said runway area.

15. An inclined ramp adapted for use in track and field training comprising:

a rigid base frame having a horizontal bottom surface and a rigid inclined surface which extends upwardly from a lower end to an upper end at an acute angle relative to said bottom surface that permits planting of an athlete's foot and jumping therefrom, said inclined surface having a length between said upper and lower ends and a width between opposite side edges of said inclined surface, said length and width having respective magnitudes which permit placement on said inclined surface of both hands and both feet of an athlete in a starter stance with the hands and feet disposed toward said upper and lower ends respectively, said bottom surface including anchors projecting downwardly therefrom which are engageable with a track surface, said anchors being comprised of tapered spikes which are engageable with a track surface, said tapered spikes being of the type used on spiked athletic shoes, and said inclined surface being covered by a resilient track material which is usable with athletic shoe spikes.

16. The inclined ramp according to claim 15, wherein said base frame includes opposite terminal ends and said inclined surface has said upper end terminating at one of said terminal ends.

17. The inclined ramp according to claim 15, wherein said rigid frame includes support ribs and a rigid plate which is rigidly supported on said ribs and defines said inclined surface.

18. An inclined ramp adapted for use in track and field training comprising:

a rigid base frame having a horizontal bottom surface and a rigid inclined surface which extends upwardly from a lower end to an upper end at an acute angle relative to said bottom surface that permits planting of an athlete's foot and jumping therefrom, said inclined surface having a length between said upper and lower ends and a width between opposite side edges of said inclined surface, said length and width having respective magnitudes which permit placement on said inclined surface of both hands and both feet of an athlete in a starter stance with the hands and feet disposed toward said upper and lower ends respectively, said bottom surface including anchors projecting downwardly therefrom which are engageable with a track surface, said inclined surface being covered by a resilient track material which is usable with athletic shoe spikes, said upper end being rigid to support jumping from said upper end when said inclined surface is in a first orientation, said lower end being wider than said upper end such that said width has a tapered shape which permits sprinter starts to be performed thereon when said inclined ramp is in a second orientation wherein an athlete's feet are positioned on said upper end and an athlete's hands are supported on said lower end.

19. The inclined ramp according to claim 15, further including a handle thereon for manual lifting and repositioning of said inclined ramp.

20. An inclined ramp adapted for use in track and field training comprising:

a rigid base frame having a horizontal bottom surface and a rigid inclined surface which extends upwardly from a lower end to an upper end at an acute angle relative to said bottom surface that permits planting of an athlete's foot and jumping therefrom, said inclined surface having a length between said upper and lower ends and a width between opposite side edges of said inclined surface, said length and width having respective magnitudes which permit placement on said inclined surface of both hands and both feet of an athlete in a starter stance with the hands and feet disposed toward said upper and lower ends respectively, said bottom surface including anchors projecting downwardly therefrom which are engageable with a track surface, said inclined surface being covered by a resilient track material which is usable with athletic shoe spikes, and said width proximate said upper end being greater than a width of a starter block having a pair of foot supports.

21. An inclined ramp adapted for use in track and field training comprising:

a rigid base frame having a horizontal bottom surface and a rigid inclined surface which extends upwardly from a lower end to an upper end at an acute angle relative to said bottom surface that permits planting of an athlete's foot and jumping therefrom, said inclined surface having a length between said upper and lower ends and a width between opposite side edges of said inclined surface, said length and width having respective magnitudes which permit placement on said inclined surface of both hands and both feet of an athlete in a starter stance with the hands and feet disposed toward said upper and lower ends respectively, said bottom surface including anchors projecting downwardly therefrom which are engageable with a track surface, said inclined surface being covered by a resilient track material which is usable with athletic shoe spikes, and said inclined surface having a starter block which is removably disposed thereon near said upper end, said starter block including a plurality of foot supports.

22. The inclined ramp according to claim 21, wherein said starter block includes spikes which engage said inclined surface and prevent sliding of said starter block along said inclined surface.

* * * * *